United States Patent [19]

Paul

[11] 4,195,375

[45] Apr. 1, 1980

[54] PATIENT LIFTING DEVICE

[76] Inventor: Korchinski N. Paul, 121 N. 3rd St., Alhambra, Calif. 91801

[21] Appl. No.: 958,108

[22] Filed: Nov. 6, 1978

[51] Int. Cl.[2] ..... A47B 83/04

[52] U.S. Cl. ..... 5/81 R; 3/86

[58] Field of Search ..... 5/60, 61, 63, 81 R, 5/84, 86, 89; 224/49

[56] References Cited

U.S. PATENT DOCUMENTS

| | | | |
|---|---|---|---|
| 503,105 | 8/1893 | Tingley | 5/81 R |
| 2,655,667 | 10/1953 | Burkert | 5/61 |
| 3,383,717 | 5/1968 | Underwood | 5/61 |
| 3,493,979 | 2/1970 | Koll et al. | 5/86 |

*Primary Examiner*—Casmir A. Nunberg

*Attorney, Agent, or Firm*—Ralph B. Pastoriza

[57] ABSTRACT

The patient lifting device comprises a frame structure including tube members supported at a given level above a patient's bed running generally parallel to each other and to the patient. Flexible straps are arranged to be passed under longitudinally spaced portions of the patient. The end portions of these straps are pulled up opposite sides of the patient and over the parallel tube members. The extreme ends are then inserted in a slot defined between two closely spaced parallel rods. These parallel rods are mounted for rotation about a fixed axis intermediate the axis of each rod so that the extending end portions of the straps are coiled up on the closely spaced rods thereby exerting equal lifting forces to raise the patient from the bed without rolling the patient.

9 Claims, 7 Drawing Figures

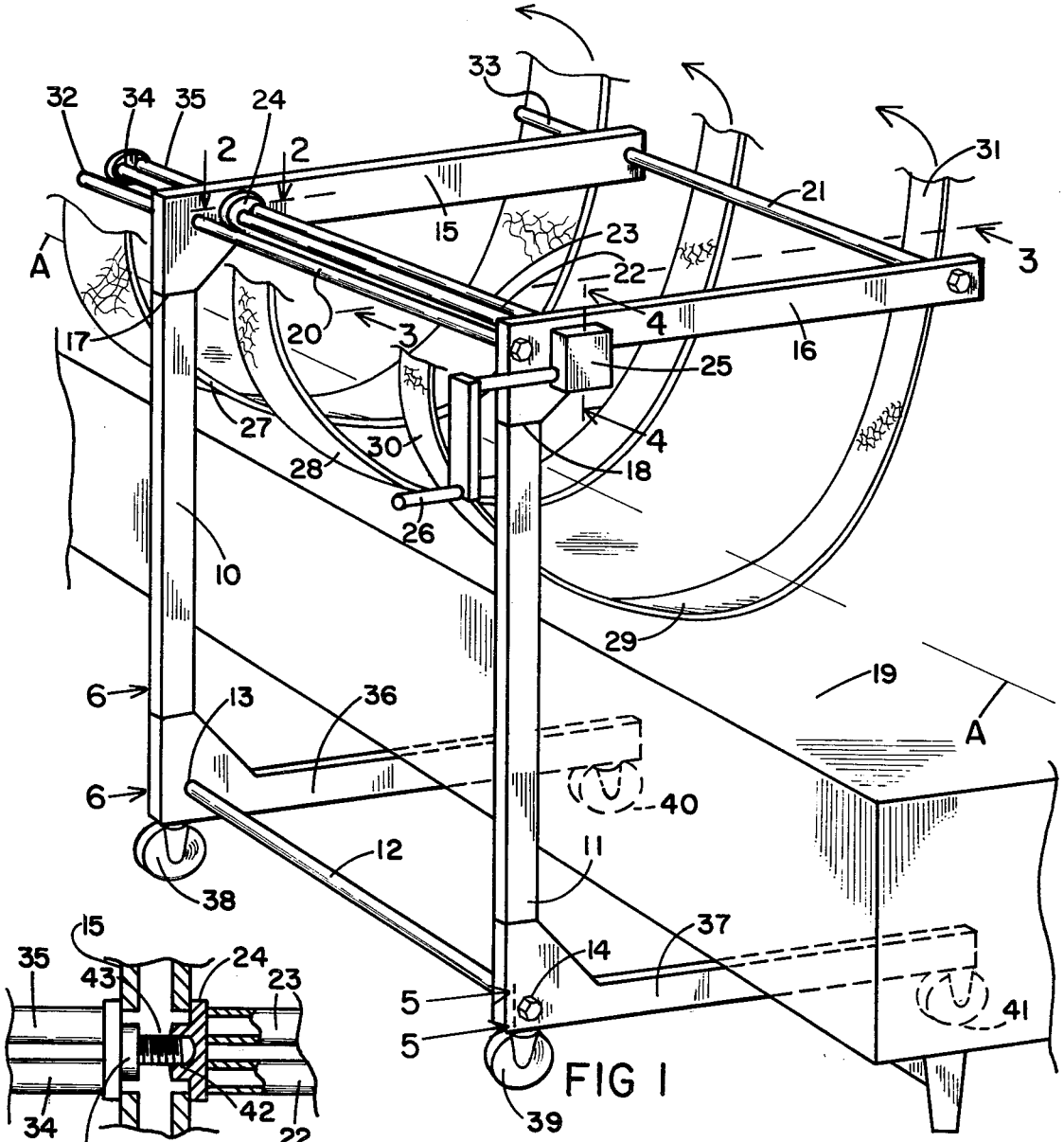
FIG 1
FIG 2
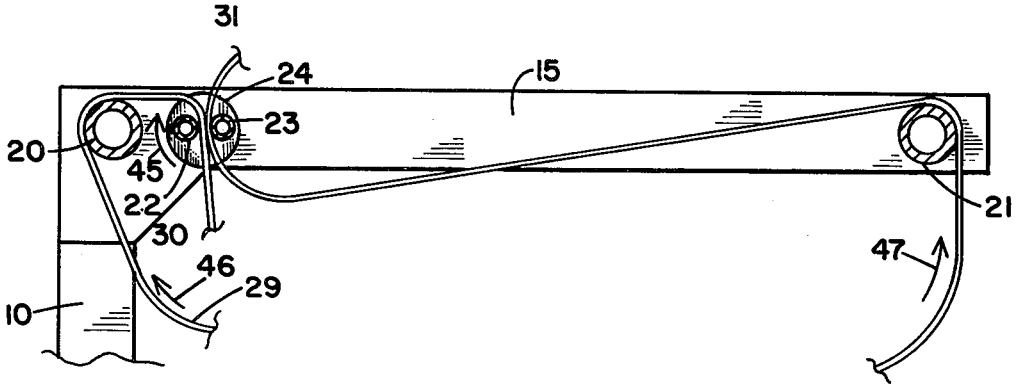
FIG 3

PATIENT LIFTING DEVICE

This invention relates generally to lifting devices and more particularly to an improved patient lifting apparatus for use in hospitals, convalescent homes and the like to facilitate lifting and maneuvering of immobile patients lying in beds.

BACKGROUND OF THE INVENTION

Lifting devices for raising immobile patients in hospitals, convalescent homes, nursing homes, retirement homes and even for residential use are well known in the art. However, many such prior art devices are relatively complicated and thus expensive. Moreover, they are difficult to operate, often requiring a skilled technician.

In addition, some of these prior art devices constitute more or less permanent installations in conjunction with a bed and thus can be an obstructive nuisance to a nurse or aide in making up the bed. Further problems associated with some prior art lifting devices is their tendency to roll the patient rather than lift the patient evenly in a vertical direction. Also, there is a tendency for bed clothing and the like to become snagged in certain interworking parts of some of these lifting mechanisms.

BRIEF DESCRIPTION OF THE PRESENT INVENTION

Bearing the foregoing in mind, the present invention contemplates a vastly improved patient lifting device overcoming substantially all of the foregoing mentioned prior art problems.

More particularly, the device of the present invention is of extremely simple construction so as to be easy to clean, essentially portable in use, simple to operate so that any non-technician can readily utilize the same and which will effect lifting of the patient without any tendency for rolling the patient.

Briefly, the device includes a basic frame structure having at least two spaced parallel members supported at a given level above a bed upon which a patient is lying. In one embodiment, the frame supporting the members includes horizontal legs arranged to extend beneath the bed and is provided with casters so that the lifting device can readily be rolled up to the bed. In a second embodiment, the frame structure includes lower horizontal frame members which rest on the bed on either side of a patient.

In each of the embodiments of this invention, at least one and preferably several flexible separable straps are provided for positioning beneath the patient, the strap having free opposite end portions extending up along opposite sides of the patient for passing over the parallel members respectively.

A holding and turning means is mounted on the frame to receive the free ends of the strap in such a manner as to coil the free ends of the straps simultaneously as the holding and turning means is turned.

With the foregoing arrangement, equal lifting forces are provided on the opposite end portions of the strap so that the patient is lifted evenly without any forces being generated tending to roll the patient.

BRIEF DESCRIPTION OF THE DRAWINGS

A better understanding of this invention as well as further features and advantages thereof will be had by now referring to the accompanying drawings in which:

FIG. 1 is a perspective view of a first embodiment of the patient lifting device of this invention;

FIG. 2 is a fragmentary view partly in cross section taken in the direction of the arrows 2—2 of FIG. 1;

FIG. 3 is a cross section taken in the direction of the arrows 3—3 of FIG. 1;

DETAILED DESCRIPTION OF THE INVENTION

Figure 4:
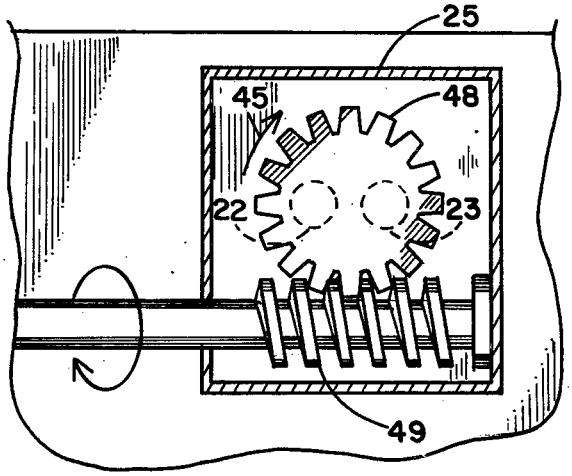
FIG. 4 is a fragmentary cross section taken in the direction of the arrows 4—4 of FIG. 1.

Referring to FIG. 1 there is shown a first embodiment of the invention comprising a frame having upwardly extending parallel legs 10 and 11. A lower horizontal member 12 which may be tubular is secured to the lower ends of the legs as at 13 and 14 so as to extend between these ends and hold the legs in fixed spaced relationship.

Referring to the upper portion of the frame, there are provided parallel arms 15 and 16 secured to the upper ends of the legs 10 and 11 as at 17 and 18. These arms extend horizontally to overlie a portion of a bed indicated generally by the arrow 19.

Shown extending between the arms at the points where they extend from the upper ends of the legs is a first upper horizontal member 20, preferably of tubular shape and preferably being provided with a smooth chrome surface. A second upper horizontal member is shown at 21 secured to and extending between the extending ends of the arms 15 and 16. The first and second members 20 and 21 are parallel to each other and to a patient lying in the bed 19. The longitudinal direction of the patient is indicated by the dashed axis A—A on the bed 19.

A holding and turning means is mounted on the frame structure and takes the form of a pair of closely spaced parallel rods 22 and 23 extending between intermediate points on the arms 15 and 16 so as to lie in the plane of the arms between and parallel to the first and second members 20 and 21. Appropriate end mounting means 24 and 25 are provided for these rods so that the rods can rotate together about a common longitudinal axis between the individual axis of each rod. A means for rotating the rods about this common axis comprises a manually operable crank 26 connecting into an appropriate gear arrangement constituting part of the end mounting means 25 all as will be described in detail subsequently.

At least one and preferably several separable flexible straps partially shown at 27, 28 and 29 are provided for passing under longitudinally spaced portions of a patient on the bed 19 with the free end portions of the straps passing up opposite sides of the patient. Such free end portions, for example, are shown at 30 and 31 for the flexible strap 29. These end portions 30 and 31 pass over the first and second parallel members 20 and 21 and the extreme ends are insertable between the closely spaced parallel rods 22 and 23 of the holding and turning means described, as indicated by the arcuate arrows in FIG. 1.

It can be understood that with the foregoing arrangement, rotation of the closely spaced rods 22 and 23 about their common axis will coil up the end portions 30 and 31 of the strap 29 as well as the end portions of the other straps simultaneously to thereby lift a patient beneath which the straps pass without rolling the patient.

Where a relatively tall or long patient is involved, there may be provided extension portions for the first and second upper horizontal members 20 and 21 such as indicated at 32 and 33 securable to the arm such as the arm 15 in alignment with the members. These extension portions will thus increase the effective overall length of the members. Further, there may be provided an extension portion comprised of closely spaced parallel rods 34 and 35 securable to and rotatable with the end mounting means 24 in the one arm 15 to provide an extension of the holding and turning means.

In the embodiment of FIG. 1, these extension portions are shown in the drawing as described and will serve to support the first mentioned strap 27 which may be substantially wider than the other straps. For example, the strap 27 may cradle a patient's head when the complete body of the patient is to be lifted. In this respect, it will be understood that the extending end portions of the wide strap 27 will be received between the closely spaced rods 34 and 35.

The lifting device described in FIG. 1 is completed by the provision of lower horizontal parallel legs 36 and 37 secured to and extending from the lower ends of the upwardly extending parallel legs 10 and 11. These horizontal legs are parallel to and vertically beneath the parallel arms 15 and 16 so that the horizontal parallel legs can be received under the bed 19 to support the arms over the bed as illustrated. Appropriate caster wheels indicated at 38 and 39 on the lower end of the upwardly extending legs 10 and 11 and at 40 and 41 on the underside of the far ends of the horizontally extending legs 36 and 37 are provided so that the frame can be rolled to transport a patient after the patient has been lifted and is cradled in the straps.

Referring now to the fragmentary view of FIG. 2, one means for securing the extension portion in the form of the closely spaced parallel rods 34 and 35 to the holding and turning means comprising the rods 22 and 23 is shown. Thus, the rotatable end mounting means 24 includes an interiorly threaded hub portion 42 received in the side of the arm 15 for cooperation with a threaded bolt 43 in turn secured to a hub or end mounting 44 for the extension portion rods 34 and 35. The extension portion of the holding and turning means can readily be removed by simply unthreading the bolt 43 from the interior threaded hub 42 whenever the device does not require such extension.

The extension portions for the first and second members 20 and 21 shown at 32 and 33 may similarly be secured to these members.

Referring now to FIG. 3, the operation of the lifting straps briefly described in FIG. 1 will become clear. Thus, for the strap 29 described in FIG. 1 the end portions 30 and 31 are shown received between the closely spaced rods 22 and 23. When these rods 22 and 23 are rotated about a common axis between the individual rod axis by rotation of the end mounting 24, such rotation being indicated by the arrow 45, it will be appreciated that the end portions 30 and 31 of the straps will be coiled up about the two rods, thereby exerting equal pulling forces on the straps as indicated by the arrows 46 and 47. As all of the straps are simultaneously wound up, it will be appreciated that the patient is thus lifted from the bed.

FIG. 4 illustrates in more detail the end mounting means 25 wherein within the housing there is provided a star gear 48 rotatable with the closely spaced rods 22 and 23 shown in phantom lines. A worm gear 49 in turn intermeshes with the teeth of the star gear 48, the worm gear 49 being rotatable by the handle 26 described in FIG. 1.

By use of a star gear and cooperating worm gear, the position of the straps and thus the lifted patient is automatically locked at any elevation when the crank or handle is not turned. In other words, incremental lifting or lowering of the patient is readily carried out by simply rotating the crank 26 described in FIG. 1 in one direction or the other, the particular adjusted level remaining because of the worm and star gear combination.

Figure 5:
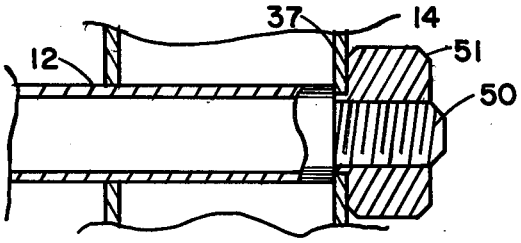
FIG. 5 is a fragmentary view partly in cross section taken in the direction of the arrows 5—5 of FIG. 1.

The fragmentary view of FIG. 5 clearly shows one example of a simple means for securing the lower horizontal member 12 of the frame to the lower end portions of the upwardly extending legs 10 and 11. Thus, the member 12 may be provided with an integrally extending threaded bolt portion 50 receivable through appropriate openings in the frame portion 37. A nut 51 is then received on the threaded bolt 50 as shown.

Referring back to FIG. 1, the near end of the horizontal members 20 and 21 may similarly be secured to opposite end portions of the horizontal arm 16.

Figure 6:
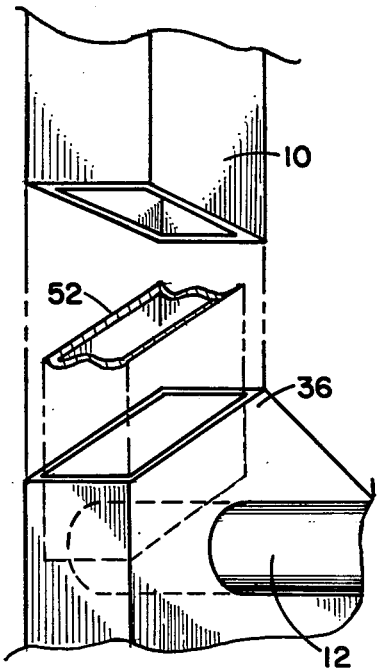
FIG. 6 is a fragmentary exploded perspective view of a portion of the frame structure looking in the direction of the arrows 6 of FIG. 1; and, FIG. 7 is a perspective view of a second embodiment of the patient lifting device of this invention.

FIG. 6 is illustrative of the manner in which the upper and lower ends of the vertical legs 10 and 11 are secured to the arms 15, 16 and the horizontal legs 36 and 37 respectively. Each such securement for the upper and lower ends of the legs is identical and thus a description of one will suffice for all. Thus, as shown for the lower end of the leg 10, the leg itself is in the form of a square hollow channel member for cooperation with an insert indicated at 52 which has its opposite ends telescoped into the channels to lock the lower end of the leg to the horizontal leg 36 by way of example. The insert 52 itself is a rectangular channel shape with bowed in ends and sides to provide a spring effect so that it must be collapsed slightly to be frictionally telescopically received within the open end channels of the leg 10 and 36. As mentioned, similar inserts can be provided at the upper leg securement points as at 17 and 18 described in FIG. 1.

Figure 7:
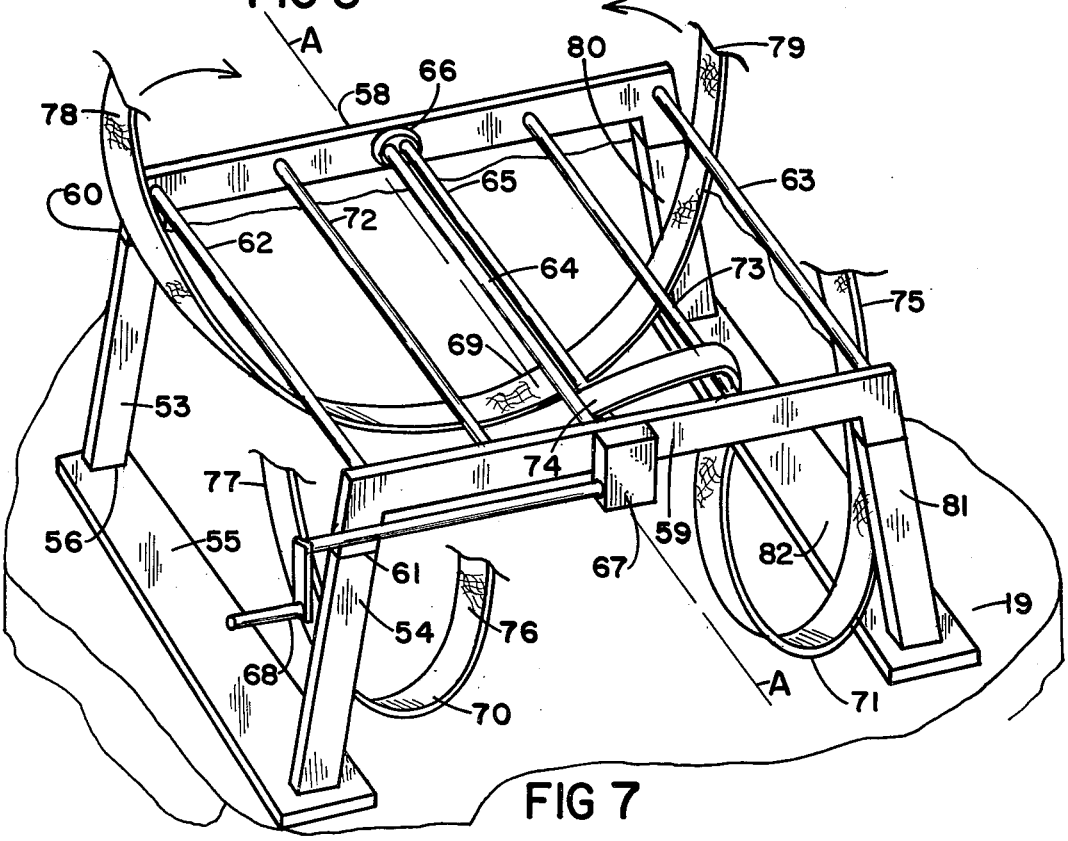

FIG. 7 illustrates a second embodiment of the invention which in basic principle is identical to the first described embodiment except that the embodiment of FIG. 7 is more portable and arranged simply to lift a portion of a patient rather than lift the entire patient for transfer to another location as can be accomplished by the embodiment of FIG. 1.

Referring specifically to FIG. 7, there is provided a frame structure which again comprises parallel vertical legs 53 and 54 with a lower horizontal member 55 secured to the lower ends of the legs as at 56 and 57 and extending therebetween to hold them in spaced relationship. Parallel horizontal arms 58 and 59 in turn extend from the upper ends of the legs 53 and 54, the same being secured thereto as at 60 and 61. Also, first and second horizontal members preferably tubular in shape with smooth chrome surfaces are shown at 62 and 63 extending between the opposite ends of the arms 58 and 59 in parallel relationship. Again, these arms are at a given spacing above the bed 19 and run generally parallel to a patient lying on the bed as depicted by the axis A—A.

Appropriate holding and turning means in the form of closely spaced parallel rods 64 and 65 are provided between rotatable end mounting means 66 and 67. The mounting means 67 incorporates an appropriate star gear and worm gear for rotation by a crank 68 as described in FIG. 4 for the embodiment of FIG. 1.

In the embodiment of FIG. 7, the holding and turning means is disposed at approximately mid-points of the arms 58 and 59 but still lie in the plane of the horizontal member 62 and 63 and between these members.

Also shown in FIG. 7 are separable flexible straps 69, 70 and 71. Additional horizontal members in the form of rods or tubes are shown at 72 and 73 extending between intermediate points of the arms 58 and 59, these rods being parallel to and spaced inwardly of the first and second horizontal members 62 and 63.

With the foregoing arrangement, certain of the straps such as the strap 71 may have an end portion passed under a patient and thence over the additional rod 73 to be received between the closely spaced rods 64 and 65 as indicated at 74. The other extending end portion 75 of the strap 21 will pass over the second horizontal member 63 and also between the rods 64 and 65 so that when the closely spaced rods 64 and 65 are rotated about a common axis to coil up the extending end portions, the loop of the strap will raise upwardly evenly in the same manner as the straps described in FIGS. 1 and 3.

The strap 70 in FIG. 7 can be similarly secured to the holding and turning means in the form of the closely spaced rods 64 and 65 so that two separated strap loops are defined for receiving, for example, the legs of a patient.

The strap 69 in turn could be placed under the back portion of the patient with its extending end portions 78 and 79 looped about the first and second members 62 and 63 and thence inserted in the closely spaced rods 64 and 65 of the holding and turning means. This configuration is very convenient for raising the patient for insertion, for example, of a bedpan. In this respect, the separate loops provided by the straps 70 and 71 will hold the patient's upper leg portions properly spaced.

The frame structure of FIG. 7 is completed by the provision of additional parallel upwardly extending legs 80 and 81 including a lower horizontal member 82 secured to and extending between the lower ends of these legs. The upper ends of the legs 80 and 81 in turn connect to the far ends of the arms 58 and 59. The horizontal members 55 and 82 will thus rest on the bed 19 on opposite sides of the patient so that the arms 58 and 59 extend transversely across the upper portion of the patient at an appropriately vertically spaced level.

OPERATION

The operation of each of the embodiments of FIGS. 1 and 7 will be evident from the foregoing description.

As already mentioned, the embodiment of FIG. 1 would be used where it is desired to lift the entire body of the patient free of the bed for purposes of making the bed or transferring the patient from the bed to a gurney or other location.

In actual use, it is only necessary, considering the embodiment of FIG. 1 to roll the frame with the horizontal legs 36 and 37 extending beneath the bed 19 as shown. The separable straps are then simply passed under longitudinally spaced portions of the patient as described and the end portions of the straps brought up opposite sides of the patient and about the horizontal members 20 and 21. These end portions are then inserted between the closely spaced rods 22 and 23 of the holding and turning means as described, particularly with respect to FIG. 3.

Upon rotation of the crank 26, the rods 22 and 23 will be rotated in the direction of the arrow 45 described in FIG. 3 to thus coil up the end portions of all of the straps simultaneously. The patient will then be lifted with equal forces applied by the end portions of the straps so that the patient will not roll. The star gear and cooperating meshing worm gear will result in the patient remaining in any raised level position when the operator lets go of the crank. Turning of the crank in an opposite direction will lower the patient.

In the case of the embodiment of FIG. 7, the entire frame structure can simply be manually placed over the patient to straddle the patient. The straps are then passed under the patient's body and legs with the end portions brought up and looped about the various horizontal members all as described, the extreme end portions then being inserted between the closely spaced rods 64 and 65. Again, turning of the crank 68 will thus raise the engaged portions of the patient.

Each of the straps is comprised preferably of strong woven fiber-like material. When the end portions of the straps are received between the closely spaced rods, and the rods rotated about a common axis, the twisting action or coiling of the end portions results in layers of the straps engaging each other in very tight frictional relationship so that there is no possibility of slippage from the holding means once a few turns thereof have been completed.

Since the straps are completely separable and do not require metal buckles or the like, there is minimum possibility of any snagging of the bedcovers in any portion of the mechanism. Moreover, the operation of the entire lifting device is rendered extremely simple. Essentially, there are only three steps involved: first, the frame is placed over the bed; second, the belts are slid under the patient and their end portions inserted in the turning and holding means; and third, the patient is simply raised by rotating the crank to a desired level.

Assembly of the component parts of both embodiments of the lifting device is very simple as will be evident from the description set forth in FIGS. 5 and 6. No special tools are required except a wrench to tighten the nuts such as the nut 51 described in FIG. 5. Even this nut could be replaced with a wing nut so that no tools at all would be necessary in either assembly or disassembly of the frame structure.

From all of the foregoing, it will thus be evident that the present invention has provided a greatly improved patient lifting device overcoming many of the problems associated with prior art structures.

I claim:

1. A patient lifting device comprising, in combination:

(a) a frame having at least two spaced members supported at a given level above a bed upon which a patient is lying, said members running in horizontal directions parallel to each other and to said patient;

(b) at least one flexible separable strap for supporting the patient, said strap having opposite portions extending up along opposite sides of the patient for passing over said members respectively; and (c) holding and turning means mounted on said frame, said holding and turning means including rod means; a rotatable member secured in fixed spaced relationship adjacent to a first end of said rod means, said rotatable member being mounted for rotation in said frame; an end cap securing in fixed spaced relationship the opposite end of said rod means, said end cap being rotatably mounted in another portion of said frames so that said rod means extends parallel to said two spaced parallel members, the opposite portions of said strap passing over said members being receivable in said rod means; and means for rotating said rotatable member to thereby rotate said rod means in such a manner as to coil said opposite portions simultaneously about said rod means whereby equal lifting forces are provided on said opposite portions of said strap so that the patient is lifted evenly without any forces being generated tending to roll the patient.

2. A device according to claim 1, in which there are provided additional separable straps for positioning at longitudinally spaced portions of said patient, said additional straps having opposite portions extending up along the opposite sides of said longitudinally spaced portions of said patient respectively to pass over said members, so that said portions can be received and held in said rod means and be subject to said lifting forces when said rod means is turned.

3. A device according to claim 1, in which said rotatable member includes a star gear, said means for rotating said rotatable member including a worm gear intermeshing with said star gear and a crank for rotating said worm gear.

4. A device for lifting a patient lying on a bed, said device including, in combination:

(a) a frame including upwardly extending parallel legs;

(b) a lower horizontal member secured to and extending between the lower ends of the legs to secure them in spaced relationship;

(c) parallel arms secured to and extending horizontally from said upper ends of said legs respectively to overlie a portion of said bed;

(d) a first upper horizontal member secured to and extending between the ends of said arms at the points they extend from the upper ends of said legs;

(e) a second upper horizontal member secured to and extending between the extending ends of said arms, said first and second members being parallel to each other and to the patient lying in said bed;

(f) rod means extending between intermediate points on said arms so as to lie in the plane of said arms between and parallel to said first and second members;

(g) end mounting means for said rod means rotatably mounting the rod means to said arms for rotation about a longitudinal axis;

(h) means for rotating said rod means in said mounting means; and (i) flexible straps for supporting longitudinally spaced portions of the patient, the straps passing up opposite sides of the patient to be received over said first and second members respectively, portions of the straps being insertable in said rod means whereby rotation of said rod means simultaneously coils up the inserted portions of all of said straps to thereby lift the patient from the bed without rolling the patient.

5. A device according to claim 4, in which said frame further includes parallel legs secured to and extending from the lower ends of said upwardly extending parallel legs, said horizontal legs being parallel to and vertically beneath said parallel arms so that said horizontal parallel legs can be received under said bed to support said arms over said bed; and, caster wheels on the lower ends of said upwardly extending legs and the underside of the far ends of said horizontal legs so that said frame can be rolled to transport a patient after lifting.

6. A device according to claim 5, in which one of said flexible straps is at least twice as wide as any one of the remaining straps for providing adequate support under the patient's head.

7. A device according to claim 5, including extension portions for said first and second upper horizontal members securable to one of said arms in alignment with the members to thereby increase their overall lengths, said device also including an extension portion comprised of rod means securable to and rotatable with the end mounting means in said one arm so as to be in alignment with said first mentioned rod means to provide an extension thereof.

8. A device according to claim 4, in which said frame further includes additional upwardly extending parallel legs; and, an additional lower horizontal member secured to and extending between the lower ends of the additional legs to secure them in spaced relationship, the upper ends of said additional legs being secured to the extending ends of said horizontal arms so that said frame can be positioned on a bed over a patient with the first mentioned lower horizontal member resting on the bed on one side of the patient and said additional lower horizontal member resting on the bed on the opposite side of the patient.

9. A device according to claim 8, in which there are provided additional members extending between intermediate points of said arms running parallel to and spaced inwardly from said first and second members whereby separable lifting strap loops can be provided by passing the end portions of a strap under the individual legs of a patient after passing over said first and second members and thence passing said end portions over the additional members prior to inserting in said rod means.

* * * * *